US007648131B2

(12) United States Patent
Hagan et al.

(10) Patent No.: US 7,648,131 B2
(45) Date of Patent: Jan. 19, 2010

(54) HORIZONTAL HOLD DOWN CLAMP

(75) Inventors: Ken Hagan, Eastpointe, MI (US); David Martin, Dearborn, MI (US)

(73) Assignee: Delaware Capital Foundation, Inc., Wilmington, DE (US)

( * ) Notice: Subject to any disclaimer, the term of this patent is extended or adjusted under 35 U.S.C. 154(b) by 3 days.

(21) Appl. No.: 11/267,661

(22) Filed: Nov. 4, 2005

(65) Prior Publication Data

US 2007/0102859 A1 May 10, 2007

(51) Int. Cl.
*B25B 1/14* (2006.01)

(52) U.S. Cl. ..... 269/228; 269/201; 269/233

(58) Field of Classification Search ..... 269/228, 269/32, 233, 201, 95; 29/251
See application file for complete search history.

(56) References Cited

U.S. PATENT DOCUMENTS

| | | | | | |
|---|---|---|---|---|---|
| 2,162,133 | A | * | 6/1939 | Spire | 269/228 |
| 2,165,322 | A | | 7/1939 | Weston | |
| 2,350,034 | A | | 5/1944 | Herrington | |
| 2,386,567 | A | * | 10/1945 | Olson | 269/228 |
| 3,170,214 | A | * | 2/1965 | Cochrane | 269/228 |
| 3,748,936 | A | * | 7/1973 | Minasy | 83/162 |
| 4,363,476 | A | * | 12/1982 | Whittle | 269/228 |
| 5,055,727 | A | * | 10/1991 | Kenderdine | 310/78 |
| 5,527,024 | A | | 6/1996 | Dysktra | |
| 5,967,502 | A | * | 10/1999 | Dykstra | 269/32 |
| 6,595,507 | B2 | * | 7/2003 | Dykstra | 269/228 |
| 6,932,335 | B1 | | 8/2005 | Dykstra | |

FOREIGN PATENT DOCUMENTS

| | | |
|---|---|---|
| DE | 3604995 | 5/1987 |
| DE | 91 01 555.3 | 6/1991 |
| DE | 94 17 667.1 | 2/1995 |
| DE | 19714861 | 8/1998 |
| EP | 1 285 731 A2 | 2/2003 |
| EP | 1 440 768 A1 | 7/2004 |
| GB | 1440768 | 3/2006 |

* cited by examiner

*Primary Examiner*—Lee D Wilson
(74) *Attorney, Agent, or Firm*—Harness, Dickey & Pierce, P.L.C.

(57) ABSTRACT

A horizontal hold down clamp that includes a base member. The hold down clamp further includes a bar member pivotally connected at a fixed point to the base member. A handle is pivotally connected to the base member at a fixed point. The clamp also includes a link connected pivotally to the handle member and the bar member. The clamp may also include a spindle arranged on the bar members and a locking lever arranged on the side of the handle member.

10 Claims, 4 Drawing Sheets

FIG. 4.
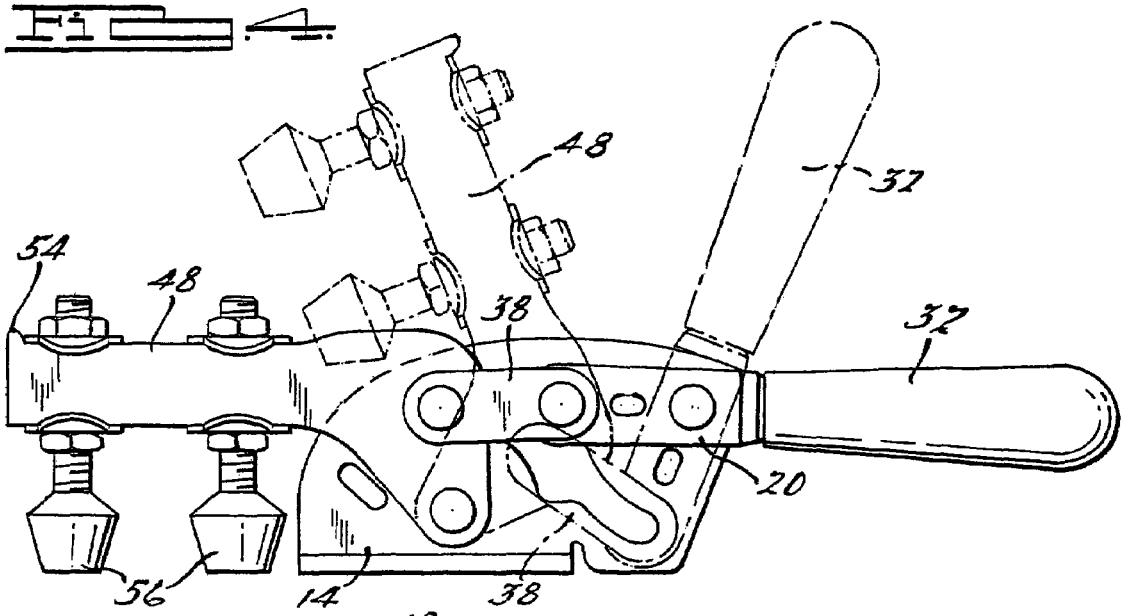
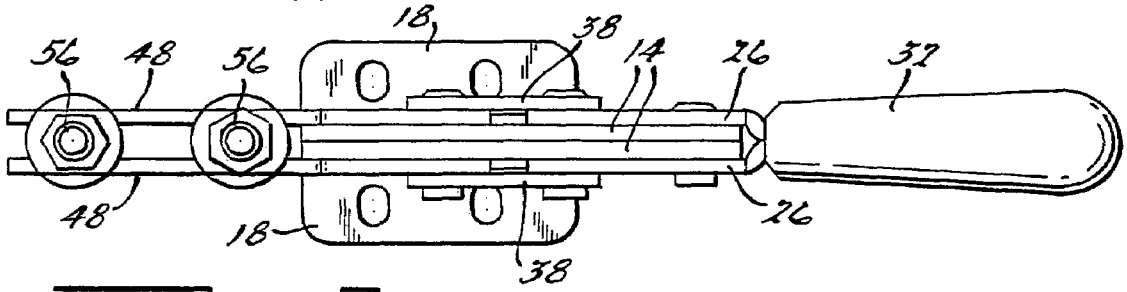
FIG. 5.
FIG. 6.
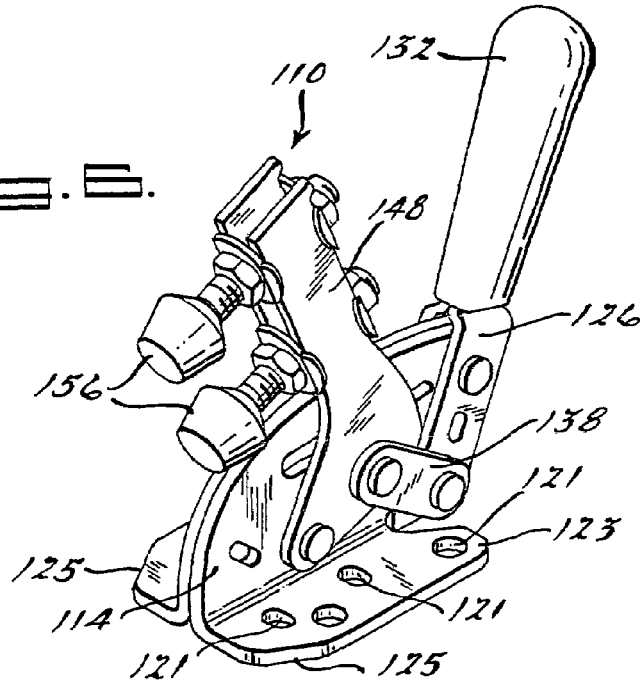

FIG. 7.
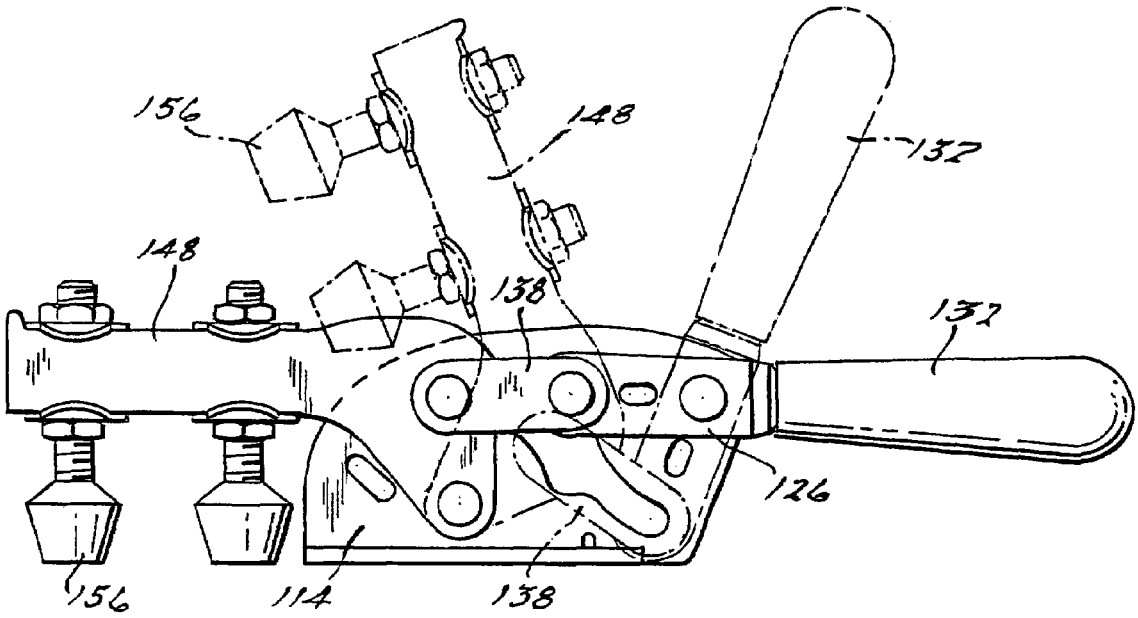
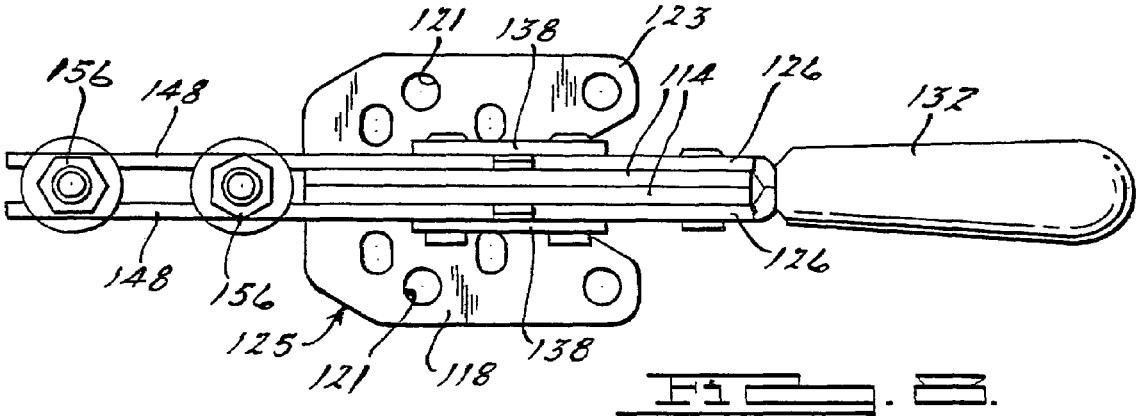
FIG. 8.
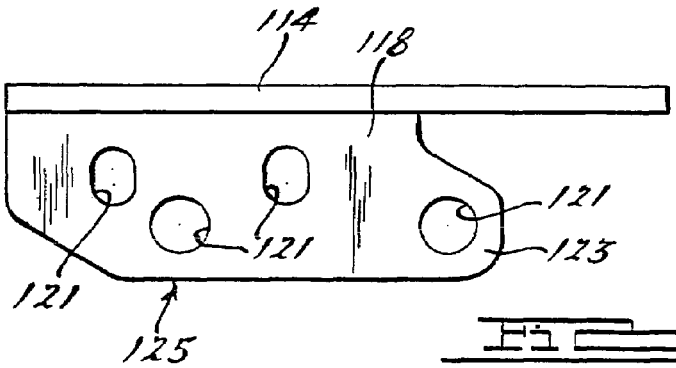
FIG. 9.

HORIZONTAL HOLD DOWN CLAMP

BACKGROUND OF THE INVENTION

1. Field of the Invention

The present invention relates to clamps generally, and more particularly, relates to a manual horizontal hold down clamp.

2. Description of Related Art

Toggle and hold down clamps have been used and known in the art for many years. The typical hold down or toggle clamp includes a clamping arm which pivots between a released and clamped position. The clamps are used to hold work pieces in place for processing, for clamping two objects to one another, or for clamping an object to a work table or other surface. Toggle and hold down clamps generally are quickly engageable and disengageable to the work piece or object being held. They also provide a considerable holding and clamping force which enables them to hold the work piece or object securely where needed. Many of these prior art clamps hold the clamp position through a variety of means, these means include maintaining the force applied to the bar or arm of the clamp. Other prior art clamps use a releasable latch assembly for a toggle clamp. Further, prior art clamps create a holding force by passing the links of the toggle clamps to an over center position, the over center position subjects the links and the pivot points of the clamp to very high loads resulting in increase wear and potential deformation of the clamp components thereby reducing the life of the clamp. There have also been problems with the prior art clamps releasing due to vibration and other unforeseen forces during the use of the clamps. Many of these prior art clamps also include several bends in the links and power arms of the clamp, thus reducing performance strength. Furthermore, many of these prior art clamps that include parts that have bends are not interchangeable and have to be put together in a predetermined manner, thus increasing the cost of labor of assembling the clamps. This also increases the number of parts needed to build the specific number of clamps in the prior art.

Therefore, there is a need in the art for a new horizontal toggle hold down clamp that is more robust, has greater strength and interchangeability than prior art clamps. There also is a need in the art for a new horizontal hold down clamp that is capable of being locked in its fully released position and locked in its fully closed or clamped position.

SUMMARY OF THE INVENTION

One object of the present invention may be to provide an improved hold down clamp.

Another object of the present invention may be to provide a more robust hold down clamp.

Still another object of the present invention may be to provide a hold down clamp with fewer bends in the clamp parts which strengthens the individual parts and reduces their cost.

Yet a further object of the present invention may be to provide a clamp that has better interchangeability, which will improve assembly and manufacturing of the clamps.

Still another object of the present invention may be to provide a clamp that uses an adjustable pre-stop.

Yet a further object of the present invention may be to provide a clamp that uses a locking lever that locks the clamp in its fully released position and fully clamped position.

Still another object of the present invention may be to provide a toggle point that is located on an accurate and repeatable hole edge located at the end of the slot such that a rivet will contact the edge to provide a repeatable toggle pad for the over center position of the clamp.

Still a further object of the present invention may be to provide a toggle clamp with a slotted base that limits handle travel and the opening angle.

Still another object of the present invention may be to provide a toggle clamp with a very low bar pivot point that helps provide high vertical exerting forces while limiting horizontal movement of the part being clamped during the clamping operation.

To achieve the foregoing objects a horizontal hold down clamp according to the present invention includes a base. The clamp also includes a handle pivotally connected to the base at a fixed point. A link is pivotally connected to the handle. The clamp also includes a bar member pivotally connected to the base at a fixed point.

One advantage of the present invention is that it may provide an improved hold down clamp.

Another advantage of the present invention is that it may provide a more robust hold down clamp.

Yet a further advantage of the present invention is that the clamp may provide more interchangeability which will improve assembly and manufacturing of the clamp.

Still another advantage of the present invention is that it may provide a clamp with fewer bends in the clamp parts which strengthens individual parts and increases the holding force of the clamp.

Still another advantage of the present invention is that it may provide a clamp with an adjustable pre-stop.

Yet another advantage of the present invention is that it may provide a clamp with a locking lever that positively locks the clamp in its fully released position and fully clamped position.

Another advantage of the present invention is that the clamp may provide a toggle point that is located on an accurate and repeatable hole edge at the end of a slot such that a rivet will contact and provide a repeatable toggle pad for the over center toggle position.

It is yet a further advantage of the present invention that the clamp may provide a very low bar pivot point to provide high vertical exerting forces while limiting horizontal movement of the part being clamped during the clamping process.

Yet another advantage of the present invention is that it may provide a clamp that has two fixed pivot points during the clamping process.

Other objects, features and advantages of the present invention will become apparent from the subsequent description, and the appended claims, taken in conjunction with the accompanying drawings.

BRIEF DESCRIPTION OF THE DRAWINGS

FIG. 4 shows a side view of the clamp according to the present invention in both a fully released position and fully engaged clamped position.

FIG. 5 shows a top view of a clamp according to the present invention.

FIG. 6 shows an alternate embodiment of the clamp according to the present invention in its fully released position.

FIG. 7 shows the alternate embodiment of the clamp of FIG. 6 from a side view in its fully released and fully clamped position.

FIG. 8 shows a top view of the alternate embodiment clamp according to FIG. 6.

FIG. 9 shows a top view of the base member of the alternate embodiment clamp shown in FIG. 6.

DESCRIPTION OF THE EMBODIMENT(S)

The invention will now be described with reference to the drawings, wherein like numerals in different drawing figures indicate like elements.

Figure 1:
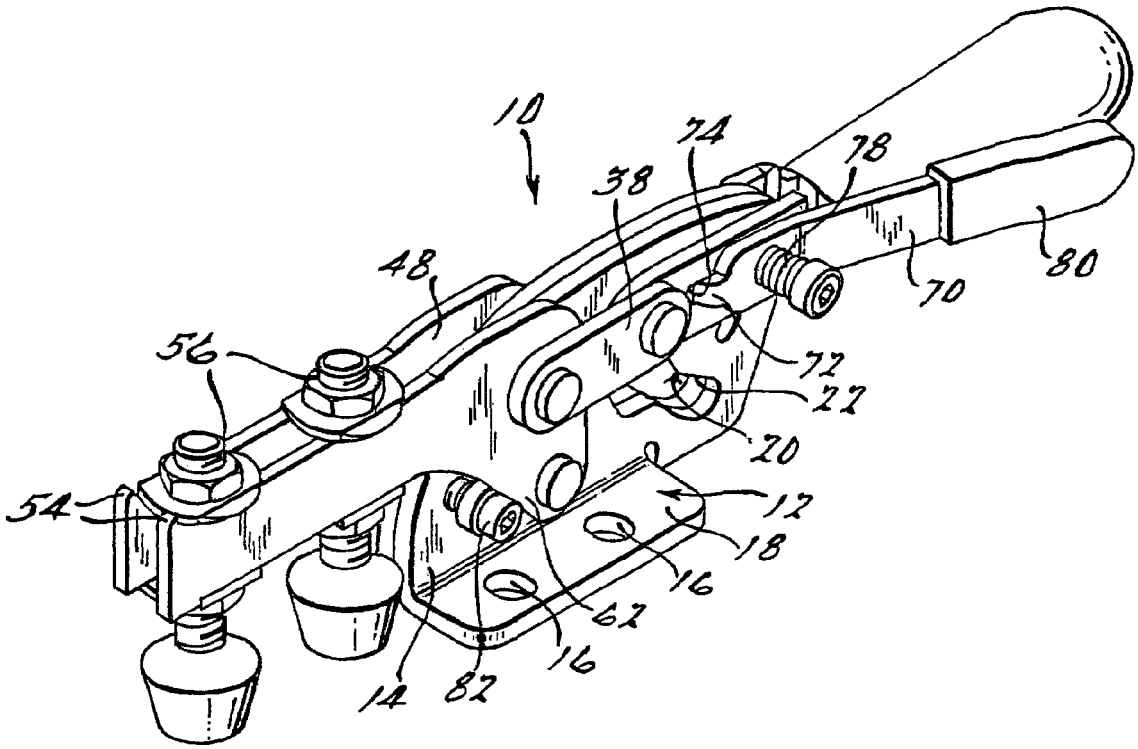
FIG. 1 shows a perspective view of a clamp according to the present invention.
Figure 3:
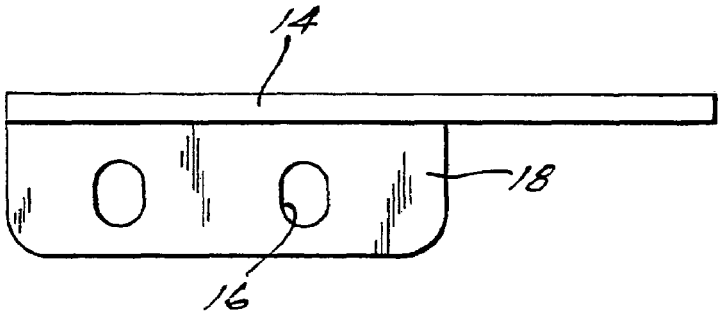
FIG. 3 shows a top view of a base member of the clamp according to the present invention.
Figure 2:
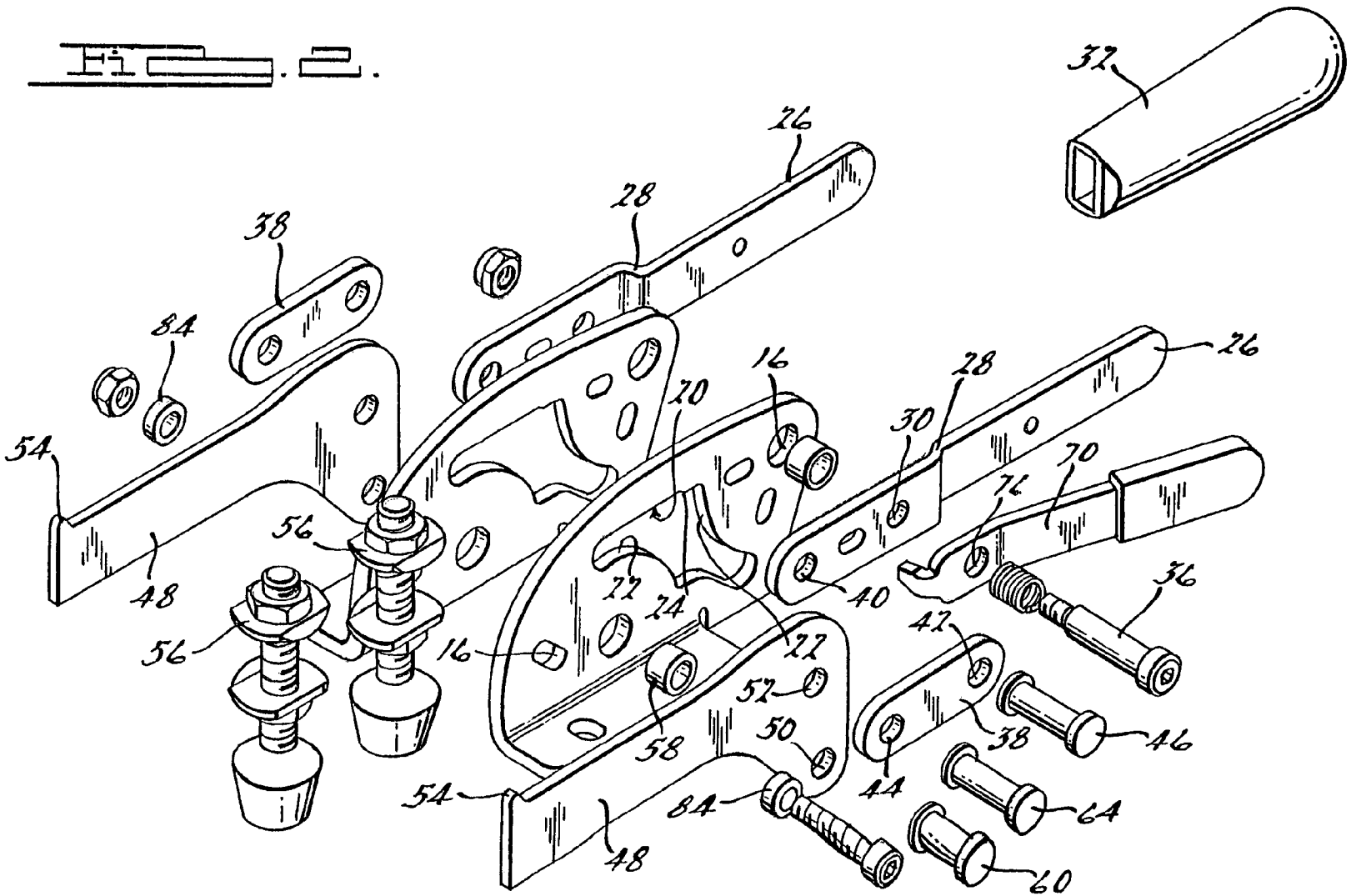
FIG. 2 shows an exploded view of a clamp according to the present invention.

FIGS. 1 through 5 show one embodiment of a horizontal hold down clamp 10 according to the present invention. The clamp 10 includes a base 12. The base 12 includes a first and second base member 14 wherein each base member 14 generally having an L-shaped cross section. The base members include a plurality of orifices 16 through a bottom flange thereof and a side surface thereof. The bottom flange or foot 18 of the base member 14 generally has two orifices 16 therein and those orifices 16 are used to secure, via any known fastener, the clamp 10 to a bench, tool, robot or other work device. The upright portion of the base member 14 includes a plurality of orifices 16 therethrough wherein the orifices 16 may be of a circular shape, an oval shape or any other known shape. The upright portion also includes a predetermined shaped slot 20 that receives two rivets or other fasteners therein and allows the rivets or fasteners to slide along predetermined curved shaped surfaces 22 to allow for the clamp 18 to be moved between its fully released and fully clamped position. Any known shape can be used for the slot 20 including any random shape or the shape as shown in FIG. 2. The slot 20 also includes at a top end thereof a toggle point in the form of a repeatable toggle pad 24 to which the rivet will contact to ensure the clamp 10 is in its over center or toggle position. The toggle point 24 is located on an accurate and repeatable edge of the slot 20 of the base 12. The toggle pad 24 can be changed to varying positions to keep a predetermined over center toggle position repeatable for the clamp 10 according to the present invention. All of the components including the base member 12 of the toggle clamp 10 are generally made of a steel material, however it should be noted that any other metal, ceramic, plastic, composite, or any other known material may be used for the clamp 10 according to the present invention. As shown in the drawings, the first and second base members 14 are arranged side by side and in one embodiment are fastened to one another via any known mechanical fastening, chemical bonding means, welding, soldering or the like. In another contemplated embodiment a single unitary member is formed with a first and second foot 18 extending therefrom and in yet another contemplated embodiment the first and second base members 14 are arranged next to one another and are held together via the force of the other components of the clamping mechanism 10. Each of the feet 18 of the base member 14 are secured to a work bench, a robot, a work piece, or other surface to allow for the horizontal hold down clamp 10 to be prepositioned with respect to a work piece being held. This will ensure that the clamp 10 will stay in the toggle position during the operations being performed on the work piece being held. The foot 18 of the base members 14 extend away from each other when the clamp 10 is assembled.

A first and second handle 26 member are in contact with and arranged around the outside surface of the base members 14. The handles 26 generally have an offset or bend 28 at a predetermined point along the handle members 26. The offsets 28 allow for the handle 26 to be pivotally attached to the base members 14 while still allowing for the handle 26 to have an easy grip for the user of the clamp 10. The handle member 26 will include a plurality of orifices therethrough with one orifice 30 being used to pivotally connect the handle members 26 to the base members 14 through one of the orifices 16 through the base members 14. This will be a pivot connection at a fixed point with relation to the base member 14. The handle member 26 will pivot around this portion of the base member 14 between both the fully clamped and fully released positions for the clamp 10. Arranged on an end extending from the handle members 26 of the clamp 10 is a grip 32 which is generally made out of a plastic, rubber or like material and fixed over the ends of the two handle members 26. The orifice 16 through which the handle member 26 is fixedly pivotally connected to the base member 14 is located at or near a top and rearward portion of the base member 14. As shown in the drawings a bushing 34 is arranged within the orifice 16 of the base member 14 and then any known fastener 36 such as a set screw rivet, dowel, pin, hex, screw, hex fastener or the like is used to connect the first and second handle members 26 to the outer surface of the base members 14 at its fixed pivot point.

A first and second link member 38 which generally have an oval shape, are pivotally connected to a second orifice 40 located on an end of the handle members 26. The first and second link members 38 generally have a first and second orifice (42, 44) generally arranged near each end of the link member 38. One of the orifices 42 of the link member 38 is pivotally connected to the second orifice 40 of the handle members 26. A fastener 46 such as a rivet, screw, pole, dowel, pin or the like is then arranged through the orifices 42 of the link members 38, and through the second orifice 40 of the handle members 26. The rivet or fastener 46 is also arranged through the slot 20 of the base members 14. This rivet 46 will slide along one of the curved surfaces 22 of the slot 20 of the base member 14 such that in the fully clamped over center toggle position the rivet 46 will come in contact with the toggle pad 24 and toggle point at the end of the slot 20 of the base member 14. In its fully open position the rivet 46 will be arranged within another pocket of the slot 20 near a bottom portion of the base member 14. The link 38 is arranged on an outer surface of the handle member 26 and contacts such outer surface.

A first and second bar member 48 is pivotally connected to an orifice 16 of the base member 14 at a fixed point. The bar members 48 generally have a flat and straight longitudinal edge such that no bends or offsets occur on the bar 48. The bar member 48 includes a first and second orifice (50, 52) and a lip 54 located on a top end at an edge thereof. The lip 54 will be used to secure at least one spindle 56 onto the bar members 48 of the clamp 10. The bar members 48 are pivotally connected at the fixed point to the base members 14 via the first orifice 50 located near a bottom or lower portion of the bar member 48. The orifice 16 for the base member 14 is located on the upright portion of the base member 14 on a lower or bottom portion of the upright member of the base member 14. A bushing 58 may be arranged within the orifice 16 of the base member 14 which will allow for a fastener 60 such as a rivet to pass through the orifices 16 in each bar member 48 and to be secured to an outer surface of the base member 14. This will allow the bar members 14 to be fixedly pivotable about the base member 14 at a low point on the base member 14. The bar members 48 also include a lobe 62 extending from a bottom portion thereof. The lobe 62 includes the first orifice 50 which is used to connect to the base member 14. The second orifice 52 of the bar member 48 is used to connect to the second orifice 44 of the link members 38. The link members 38 are arranged on an outer surface of the bar members 48 and have a fastener 64 such as a rivet pass through the second orifices of both the link members 38, bar members 48 and through the slot 20 of the base members 14. This will allow for a pivotal connection between the bar members 48 and the link members 38. The rivet 64 connecting the bar members 48 and link members 38 will slide along one of the curved surfaces 22 of the slot 20 within the base members 14. One portion of the curved surface 22 allows for the rivet 64 to be slid therein when the clamp 10 is in its fully clamped position while the opposite end of the curved surface 22 of the slot 20 will have the rivet 64 arranged therein when the clamp 10 is in its fully released position.

In operation the clamp 10 is in an open or released position when the handle member 26 is pulled fully open and is generally in a vertical position with relation to the feet 18 of the base member 14. The handle member 26 is designed such that the handle member 26 has a predetermined angle from the base member 14 such that there is appropriate clearance for the hands and fingers of the clamp operator. The slotted base member 14 will limit the travel of the handle 26 and the opening angle of the handle 26 to ensure a more ergonomically friendly clamp 10 for the operator of the clamp 10. The very low fixed bar pivot point will help provide high vertical exerting forces while limiting the horizontal movement of the part during clamping thereof. The bar 48 will optimize use of material and protect the linkage from overhead damage when the clamp 10 is in its fully clamped position. It should be noted that all of the components other than the handle 26 are flat components which provide for increased holding capacity while reducing the tooling costs.

When the operator wants to secure the part being clamped, the operator will move the handle 26 into a horizontal position from its first or fully released position into a second or fully clamped position such that the handle 26 is placed into a generally horizontal position with relation to the feet 18 of the base members 44. The clamp 10 secures a work piece by having an over center position between the handle members 26, the link members 38 and the bar members 48. This over center force amplifies the force and holding power of the clamp 10. The over center point is engaged when the rivet 46 connecting the handle member 26 to the link member 38 engages with the toggle pad 24 located at an end of the slot 20 of the base members 14. Engagement with this pad 24 will create the over center or highest force position for the clamp 10. FIGS. 1 and 4 show the clamp 10 in the clamped position with the rivet 46 engaging the toggle pad 24 of the slot 20 of the base members 14. The force is created by the link members 38 rotating with respect to the handle member 26 and bar member 48. The toggle pad 24 merely defines the over center position which creates the greatest force capable by the toggle link of the clamp 10. The toggle is created between the relation of the rivets connecting the handle 26 to the base member 14, the handle 26 to the link 38 and the bar members 48 to the link arms 38. The base member 14 will have a generally curved top surface which will protect the clamp 10 from untoggling during operation of the clamp 10 in the manufacturing environment. The same rise or curved surface is located on the bar members 48 to further protect against damage to the link members 38 during operation of the clamp 10. It should be noted that the thickness of the base members 14 will depend on the spindle 56 being used on the end of the bar member 48 and will allow for a predetermined amount of force to be held by the clamp 10. The two fixed pivot points found on the horizontal hold down clamp 10 of the present invention have not been used in the prior art clamps and increases the holding force of the clamps 10 along with the repeatability of the clamps 10 during operation. It should be noted that in the embodiment shown two spindles 56 are arranged on the bar members 48, however any number of spindles 56 including just one spindle may be used to create the hold down portion for the horizontal hold down clamp 10. It should also be noted that any known fastener can be used instead of the rivets which are shown in the drawings.

The hold down clamp 10 according to the present invention may include a locking lever 70 as shown in FIGS. 1 through 5. The locking lever 70 is arranged on an outside surface of the handle member 26. It should be noted that the locking lever 70 can be placed on either side of the handle member 26 depending on if the operator of the clamp is right handed or left handed. The locking lever 70 provides a positive secondary locking mechanism that locks the clamp 10 in both its fully released position and in its fully clamped position. The locking lever 70 has a predetermined bend or angle at a predetermined position along its length thereof. Extending from an end of the locking lever 70 is a locking tab 72. The tab 72 is arranged through a third orifice 74 arranged on either of the handle members 26. The orifice 74 on the handle member 26 generally has an oval shape, however any other shape may also be used. The locking lever 70 also includes an orifice 76 through a surface thereof. The orifice 76 will have the rivet or fastener 36 pass therethrough and then through the first orifice 30 of the handle member 26 and the orifice 16 of the base member 14 to the other handle member 26. A spring 78 will be arranged between the locking lever 70 and a shoulder or fastener head on the opposite end of the spring 78. The spring 78 will ensure that the locking tab 72 is urged into the orifice 74 of the handle member 26 and the appropriate orifice of the base member 14. The lever 70 will have to be pulled completely against the grip 32 of the handle 26 before the clamp 10 will open or close, thus eliminating a pinch point for the operator of the clamp 10. When the lever 70 is pulled completely against the grip 32 then the clamp 10 will be allowed to be moved from either the fully clamped position or the fully released position to the other position for the clamp 10. When the clamp 10 is either in the fully released or fully clamped position the locking tab 72 will extend completely through the orifice 74 of the handle member 26 into the orifice of the base member 14 corresponding to either the open position or fully released position for the clamp 10 or the fully closed or clamped position for the clamp 10. These orifices are located at predetermined positions on the upright portion of the base member 14 and generally have an oval shape, however any other known shape may also be used. It should be noted that the clamp 10 may be used without a locking lever 70 depending on the design requirements and needs of the manufacturer. The locking lever 70 may include a grip 80 made of a plastic, rubber, or like material over one end thereof. It should be noted that any other type of spring mechanism may be used to urge the locking lever 70 into the orifices of the handle member 26 and base members 14. In this case a compression spring is used but any other known spring or spring mechanism that creates a force may be used.

It is also contemplated to have an adjustable pre-stop member 82 arranged on the base member 14 at a predetermined position. The pre-stop member 82 can have any form but in the form shown it is a threaded fastener that has a predetermined length and head on one end thereof and nut or other fastener/bolt on the opposite end thereof. A first and second stop washer 84 may be arranged against the outer surfaces of the upright portions of the base members 14 and secured by tightening the fastener via its head and the bolt on the opposite end thereof. It should be noted that the orifice through which the pre-stop member 82 is arranged generally has an oval shape to allow for adjustment of the pre-stop 82 with relation to the bar members 48 of the clamp 10, however any other known shape may also be used. The pre-stop 82 will remove slop and wobble from the clamp 10 in the toggle position. It will also keep the clamp 10 locked in position while also allowing for the clamp to clamp on itself if a predetermined gap is needed between the spindle 56 and the work piece being held. It should be noted that the clamp 10 can operate without the use of the pre-stop 82. It should be noted that any other shaped bar members 48, base members 14, locking lever 70, handle members 26, spindles 56 or link members 38 may be used along with different shaped orifices depending on the design requirements and manufacturing environment for the manufacturer using the hold down clamps 10.

FIGS. 6 through 9 show an alternate embodiment of the hold down clamp 110 according to the present invention. It should be noted that like numerals indicate like parts. The handle members 126, link members 138, bar members 148, spindles 156 and grip 132 all are the same and operate in the same manner as those described above for the other embodiment. The base member 114 generally has the same upright shape as that of the other clamp 10 but has a foot 118 that extends as a bottom flange with a different shape from that of the previously described embodiment. The bottom flange 118 of the embodiment shown in FIGS. 6 through 9 includes at least four orifices 121 therethrough and may include more orifices. The foot or bottom flange 118 of the alternate embodiment of the clamp 110 has an extension 123 extending from one end thereof and a more tapered end 125 on the opposite end thereof. This will allow for connection to a variety of work pieces, work units, robots, and other work devices or any other surfaces for which the clamp 110 will be used. The foot print of the alternate embodiment has an orifice pattern that will be used for specific holding jobs and will allow for higher hold down forces because of the multiple connections made available to connect the base members 114 to the surface or work piece for which the clamp 110 will be used. The clamp 110 will operate in the same manner as that described above for the other embodiment.

It should be noted that the use of an over center or toggle pad 24 that is punched or formed into the metal slot is preferred over the prior art use of welding a pin or other device into the clamp. This provides a more reliable over center point thus increasing the strength and durability of the clamp. Furthermore, the interchangeability of all of the clamp members along with the fact that they use straight or linear parts increases the strength and holding capacity for the clamp. Generally, in the prior art anywhere a bend or offset is located creates stresses and weakens the clamp thus reducing the overall life and durability of the clamp. The use of the straight or linear members in the present invention increases the strength greatly over prior art clamps thus increasing the life and serviceability of the clamps in the field.

The present invention has been described in an illustrative manner. It is to be understood that the terminology which has been used is intended to be in the nature of words of description rather than of limitation.

Many modifications and variations of the present invention are possible in light of the above teachings. Therefore, within the scope of the appended claims, the present invention may be practiced otherwise than as specifically described.

What is claimed is:

1. A horizontal hold down clamp, said clamp including:

a base;

a handle pivotally connected to said base at a fixed point;

a link pivotally connected to said handle at an end of said handle;

a bar member pivotally connected to said base at a fixed point and pivotally connected to said link, said fixed pivot point of said bar member is arranged at a low point on both said bar member and said base to provide for increased vertical exerting forces while limiting horizontal movement of a part being clamped; and said base having a slot therein, said slot having a toggle contact pad at a top end thereof, said pivotal connection between said link and said handle is slidingly arranged within said slot, said pivotal connection between said bar member and said link is slidingly arranged within said slot and said slot is positioned between said fixed points such that a line drawn from fixed point to fixed point along said base passes through said slot.

2. The clamp of claim 1 further including a locking lever arranged on said handle.

3. The clamp of claim 2 further including a first lock orifice in said base and a second lock orifice in said base.

4. The clamp of claim 1 wherein said base having a curved upper edge to help protect the clamp from untoggling.

5. The clamp of claim 1 wherein said bar member having a lip at an end thereof.

6. The clamp of claim 1 further including a spindle arranged on said bar member.

7. The clamp of claim 1 further including a pre-stop connected to said base.

8. The clamp of claim 7 wherein said pre-stop is arranged within a generally oval shaped orifice of said base, said pre-stop is adjustable to predetermined positions within said orifice.

9. The clamp of claim 1 wherein said link and said bar member are flat and increase holding capacity.

10. The clamp of claim 1 wherein said slot having predetermined curved shaped surfaces to allow said pivotal connection between said handle and said link to slide along one of said curved shaped surfaces and to allow said pivotal connection between said link and said bar member to slide along another of said curved shaped surfaces.

* * * * *

UNITED STATES PATENT AND TRADEMARK OFFICE

CERTIFICATE OF CORRECTION

PATENT NO. : 7,648,131 B2
APPLICATION NO. : 11/267661
DATED : January 19, 2010
INVENTOR(S) : Ken Hagan et al.

It is certified that error appears in the above-identified patent and that said Letters Patent is hereby corrected as shown below:

Title Page:
Item [73] Assignee, "Delaware Capital Foundation, Inc." should be --Delaware Capital Formation, Inc.--

Signed and Sealed this

Eleventh Day of May, 2010

David J. Kappos

David J. Kappos
*Director of the United States Patent and Trademark Office*